United States Patent [19]

Brown et al.

[11] Patent Number: 4,542,924

[45] Date of Patent: Sep. 24, 1985

[54] DEFLECTABLE UNITARY LATCH

[75] Inventors: William J. Brown, Naperville; John M. Parks, Peoria, both of Ill.

[73] Assignee: Caterpillar Tractor Co., Peoria, Ill.

[21] Appl. No.: 508,305

[22] Filed: Jun. 27, 1983

[51] Int. Cl.[4] ..... E05C 3/14

[52] U.S. Cl. ..... 292/87; 292/DIG. 38; 292/DIG. 30

[58] Field of Search ..... 292/80, 87, 88, 89, 292/91, 19, DIG. 30, DIG. 38

[56] References Cited

U.S. PATENT DOCUMENTS

| | | | |
|---|---|---|---|
| 2,240,923 | 5/1941 | Christie | 292/87 |
| 2,826,442 | 3/1958 | Pruehs | 292/87 |
| 3,397,001 | 8/1968 | Friedman | 292/87 |
| 3,881,758 | 5/1975 | Gross | 292/87 |
| 4,057,879 | 11/1977 | Eigenbrode | 292/87 X |

FOREIGN PATENT DOCUMENTS

| | | |
|---|---|---|
| 29128 | 9/1969 | Australia . |
| 47509 | 4/1974 | Australia . |
| 350196 | 4/1928 | Belgium . |
| 2665031 | 6/1978 | United Kingdom . |

OTHER PUBLICATIONS

Publication: Modern Plastics V922, "It's A Snap With Acetal" (1962-12).

*Primary Examiner*—Richard E. Moore

*Attorney, Agent, or Firm*—Charles E. Lanchantin, Jr.

[57] ABSTRACT

A deflectable unitary latch (10) of plastic material is disclosed for securing a pivoting window (12) or the like to a frame (14) having a striker member (28) thereon. The latch (10) has a base (30), a handle (32) and a spring-like arm (34) extending from the base (30), with the arm (34) having a proximal hinge portion (36), a support strut (38), a latch portion (40) and a press bar (42). The hinge portion (36) and the support strut (38) are constructed to allow the arm (34) to be deflected primarily about the hinge portion (36) as the press bar (42) is urged toward the handle (32) for release of the latch.

7 Claims, 1 Drawing Figure

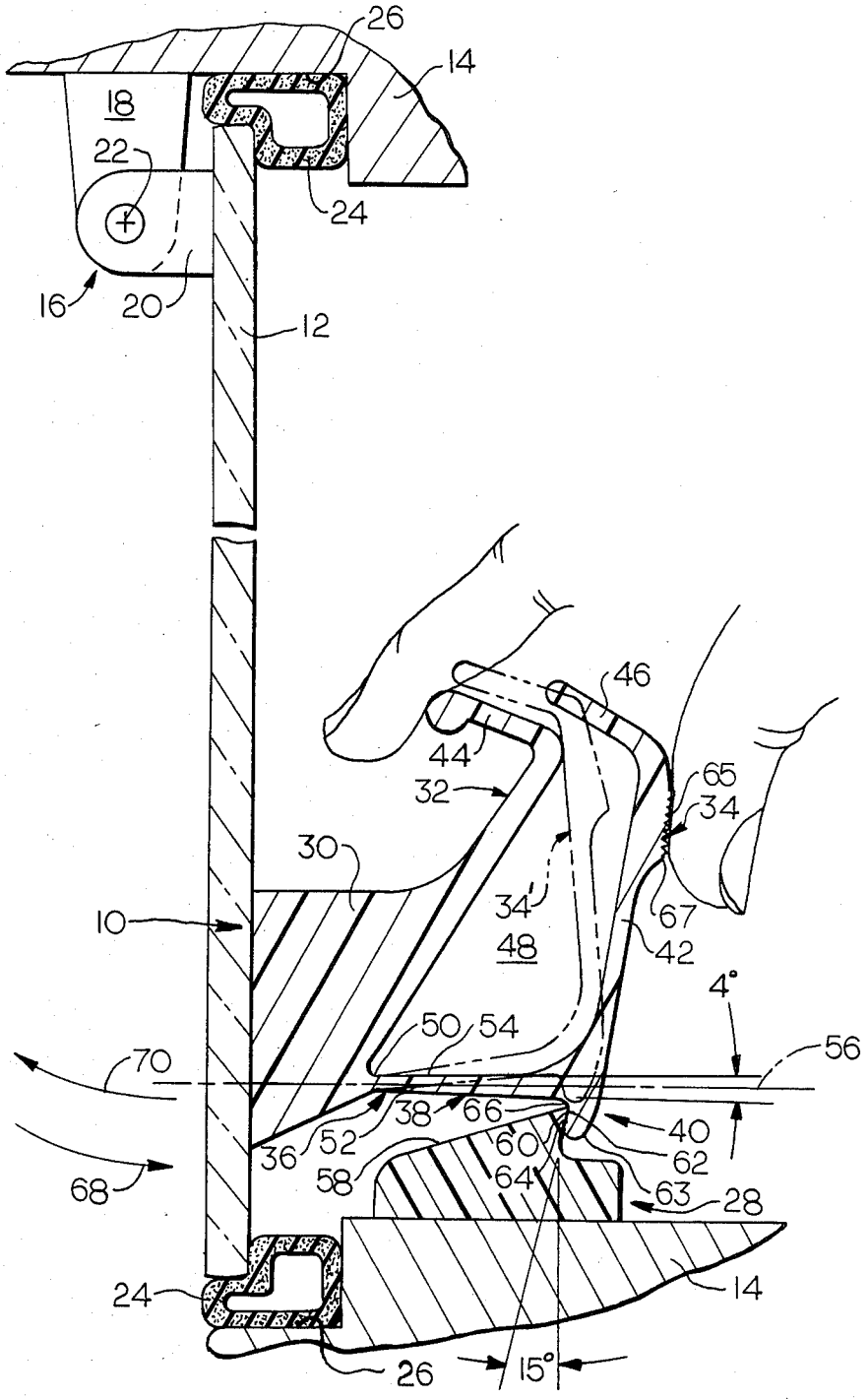
26
14
18
22
24
16
20
12
46
44
32
65
34
30
34
48
67
42
10
4°
50
54
56
70
38
66
40
36
52
60
62
58
64
63
28
68
24
14
26
15°

DEFLECTABLE UNITARY LATCH

TECHNICAL FIELD

This invention relates generally to a latch for securing a window or the like to a frame, and more particularly to a unitary latch which is interlockingly engaged with a striker member.

BACKGROUND ART

Vehicle cabs usually contain windows for visibility, and many of these windows are openable in order to provide ventilation and/or an emergency exit for the operator. Because of the various types of windows, a large number of latch mechanisms have been devised for securing the windows positively in a closed position.

However, the known latch mechanisms are complex in operation and typically require many separate parts. In addition to being too costly, the separate parts sometimes become loose or include spring members which gradually fail with age so that the window either rattles or allows water, dirt and noise into the vehicle cab.

Accordingly, what is needed is a low cost and simple latch which will positively secure a window or the like to an associated frame. In addition to having a long service life, the latch should preferably be constructed to enable it to be released quickly in an emergency or be activated to a latched position with conveniently uniform manipulating motions.

DISCLOSURE OF THE INVENTION

The present invention is directed to overcoming one or more of the above problems.

In one aspect of the invention there is provided a deflectable unitary latch for securing a window, a door or the like to a frame having a striker member thereon. Advantageously, the unitary latch includes a base adapted to be connected to the window, a handle extending from the base, and an arm extending from the base. The arm features a proximal hinge portion, a latch portion, and a press bar, with the hinge portion being so constructed and arranged as to permit the arm to be deflectably swung around it from a latched position toward a released position in response to the manual movement of the press bar toward the handle.

More specifically, the unitary latch of the present invention is preferably formed of a tough plastic material such as, for example, acetal resin that can be economically molded. The hinge portion of the latch has a throat of minimum cross sectional area to allow the arm to be deflectably swung primarily about it toward the handle, while still allowing sufficient strength for returning the arm to a free state position corresponding generally to the latched state thereof.

BRIEF DESCRIPTION OF THE DRAWING

The sole FIGURE of the drawings is a diagrammatic, transverse, elevational sectional view through a vertically suspended swingable window and employing the deflectable unitary latch of the present invention.

BEST MODE FOR CARRYING OUT THE INVENTION

An exemplary embodiment of a deflectable unitary latch 10 embodying the principles of the present invention is illustrated in the drawing in conjunction with a vertically suspended, swing-out window 12 pivotally secured to a supporting frame 14 by a conventional hinge assembly 16. The hinge assembly includes a first element 18 dependingly secured to the frame and a second embodiment 20 secured to the window in order to allow the window to be manually pushed outwardly in a clockwise direction when viewing the drawing about an upper horizontal pivot axis 22. When the window is pulled in the counterclockwise direction toward the fully closed position by grasping of the latch, the window is nested against resiliently compressible seal means 24 disposed in a recess 26 formed peripherally about the frame. At this stage the latch is automatically interlockingly engaged with a stationary striker member 28 secured to the frame.

The deflectable unitary latch 10 can be secured to the window by adhesive bonding or by any conventional fastening apparatus. It is made of a plastic material that has high mechanical strength and rigidity, resistance to fatigue, and a natural lubricity. Preferably, the unitary latch 10 is made of acetal resin containing an ultraviolet stabilizer and black pigmentation for optimum weatherability. Such material can be economically injection molded.

The unitary latch 10 has a base 30 connected to the window 12, a handle 32 integrally extending from the base at an acute angle of about 30° from the plane of the window, and a deflectable arm 34 extending from the base and generally overlying the handle. Advantageously, the deflectably returnable arm 34 includes a proximal hinge portion 36, a support strut 38 blendingly extending outwardly from the hinge portion and connected to a latch portion 40, and a press bar 42 extending outwardly from the latch portion in generally converging overlapping relationship to the handle 32.

Preferably, a finger grip end portion 44 is formed on the extremity of the handle 32 approximately normal thereto, and an arcuately shaped distal end portion 46 is formed on the extremity of the arm 34. Since the handle 32, the support strut 38, and the press bar 42 substantially define a generously sized slot 48 therebetween, a person's fingers could be pinched between the handle and arm 34 but for the distal end portion 46 which substantially closes off the slot and passes closely overlappingly by the finger grip end portion 44 during a closing operation.

As can be visualized by comparing the solid line latched position of the arm 34 and the phantom line released position thereof designated by the number 34', the arm is manually swingable primarily about the proximal hinge portion 36. In order to achieve such reproducible movement the cross sectional area of the hinge portion is blendably tapered from the base 30 relatively quickly down to a throat 50 of relatively thin or minimum cross sectional thickness, for example 0.8 to 1.5 mm. Accordingly, there is substantially no movement of the plastic material inwardly thereof toward the base. However, the hinge portion 36 has an outer planar surface 52 and an inner planar surface 54 which diverge outwardly away from the throat at a relatively narrow angle of about 4° as illustrated and generally symmetrically with respect to a central plane 56 normal to the plane of the window 12 and passing centrally through the throat. This provides a controlled cross sectional spring-like strength relationship that can be tailored for the parameters of the plastic material chosen, and can permit a relatively quickly increasing resistance toward bending or deflection in the outward direction. The surfaces 52,54 are preferably continued in the region of the support strut 38, but they are further apart thereat so that the resistance of the plastic material to bending increases and the amount of deflection decreases in the outward direction. The press bar 42 can be noted to be disposed at an obtuse angle of about 100° from the support strut or the central plane 56 in order to be inclined outwardly when latched, and to allow about 20° swinging movement thereof toward the released position.

Referring next to the rigid striker member 28, which is preferably of the same acetal resin plastic material, it has an upwardly inclined planar cam surface 58, an apex or tip 60, and a reverse angle latch abutment surface 62 inclined at about 15° with respect to the plane of the window 12. The latch portion 40 of the arm 34 has an outwardly facing arcuate nose surface 63, and an inwardly facing latch surface 64 which is inclined at the same angular relationship as the outwardly facing striker surface 62 when the arm is in its free state. Moreover, the surfaces 52,64 intersect at a corner edge 66 located relatively close to the central plane 56, and the apex 60 of the striker member is located relatively close to that corner edge. Accordingly, in the latched position shown in the drawing the outwardly acting resilient biasing force of the window seal means 24 is resisted by the slightly angled back latch surfaces 62,64 by a substantially normal force vector acting near the central plane such that the hinge portion and the support strut are desirably loaded in almost pure tension. This greatly minimizes any tendency of the latch to take an undesirable "set" after an extended service life.

The arm 34 illustrated has a serrated pedestal 65 defining a lip 67 at the inner edge thereof that provides additional gripping capability while simultaneously serving to improve the visual ornamental appearance of the latch 10.

INDUSTRIAL APPLICABILITY

The window 12 is moved in the closing direction illustrated by arrow 68 by an operator's fingertips pulling on the end portion 44 of the handle 32 and causing the window to pivot about the horizontal axis 22. The arcuate surface 63 of the latch portion 40 rides up the cam surface 58 of the striker member 28 since the striker member is disposed adjacent the window frame recess 26. Simultaneously, the arm 34 is resiliently deflected about the throat 50 toward the phantom line position 34' while the window begins to compressibly engage the seal means 24. An increased pulling force will compress the seal means further and cause the latch portion 40 to pass beyond the apex 66, whereupon the latch 10 will be positively interlockingly engaged with the striker member with a snap-like action because the spring-like arm 34 returns to its free state position substantially as illustrated due to the high mechanical flexural strength of the plastic material.

To open the latch 10 the operator would place his fingers over the handle finger grip end portion 44 and his thumb against the roughened or serrated pedestal 65 of the press bar 42 as is illustrated and squeeze. The arm 34 would then swing about the hinge portion 36 and throat 50 toward the phantom position 34' to release the latch portion 40 from the striker member 28. That action would allow the window 12 to swing outwardly in the direction illustrated by arrow 70 where it would be held in an open position by conventional means, not shown.

In an emergency, the vehicle operator can hit the press bar 42 with the palm of his hand and pivotally swing the window 12 open to quickly get out of the cab. To expedite this action the width of the latch 10 is about the width of the palm or, for example, about 11 cm.

From the foregoing description it can be appreciated that the latch 10 of the present invention is simple to operate, is easy to fabricate since the latch can be integrally made of a plastic material, and is of low cost despite the fact that it is positive in operation and substantially indestructable.

Other aspects, objects and advantages of this invention can be obtained from a study of the drawings, the disclosure and the appended claims.

We claim:

1. A deflectable unitary latch adapted to be connected, in use, to a swingable window or the like to permit the window to be releasably secured to a frame having a striker member thereon, the latch comprising:

a base adapted to be connected to the window;

a handle extending from the base; and an arm extending from the base said arm formed by a proximal hinge portion adjacent to the base, a support strut which extends outwardly from the hinge portion generally along a central plane, a latch portion, and a press bar which extends from the support strut at a first angle from the central plane in generally overlying relationship to the handle said handle extending at a second angle from the central plane, the latch portion adapted in use to be interlockingly engaged with the striker member, the hinge portion being of a construction sufficient for allowing the arm to be deflectably swung therearound from a latched position toward a released position in response to manual movement of the press bar toward the handle.

2. The latch of claim 1 wherein the first angle of the press bar is an obtuse angle in the free state thereof.

3. The latch of claim 1 wherein the handle, support strut and press bar form a slot, and the arm has a distal end portion substantially closing off the slot in the latched position and extending overlappingly beyond the handle in the released position.

4. The latch of claim 1 wherein the handle has a finger grip end portion, the latch portion being released in response to a squeezing action of an operator's fingertips between the finger grip end portion and the press bar.

5. The latch of claim 1 wherein the hinge portion has a throat of minimum cross section adjacent the base, the hinge portion being increasingly tapered from the throat outwardly from the base and blending into the support strut.

6. The latch of claim 1 wherein the hinge portion and the support strut are substantially coplanar and share external surfaces which increasingly diverge in the outward direction from the base.

7. A deflectable unitary latch of plastic material adapted to be connected, in use, to a substantially planar pivoting window in order to permit the window to be releasably secured to a frame having a striker member thereon having an ascending cam surface, an apex and a latch surface, the latch comprising:

a base adapted to be connected to the window;

a handle inclinably extending from the base; and an arm having in sequence, a proximal hinge portion, a support strut, a latch portion and a press bar, the hinge portion and the support strut being substantially aligned along a common central plane and sharing external surfaces which taperingly diverge outwardly from the base toward the latch portion permitting the arm to be deflectably swung primarily about the hinge portion from a latched position of engagement with the striker member toward a released position in response to movement of the press bar toward the handle by a squeezing action of an operator's fingertips, the press bar being disposed at an obtuse angle from the support strut in generally overlying relationship to the handle.

* * * * *